US011840847B2

(12) United States Patent
Perrine

(10) Patent No.: US 11,840,847 B2
(45) Date of Patent: Dec. 12, 2023

(54) INTERCONNECTED MODULAR FRAMES FOR GROUTLESS SETTING OF HARD TILES

(71) Applicant: Robert N. Perrine, La Mesa, CA (US)

(72) Inventor: Robert N. Perrine, La Mesa, CA (US)

( * ) Notice: Subject to any disclaimer, the term of this patent is extended or adjusted under 35 U.S.C. 154(b) by 0 days.

(21) Appl. No.: 17/750,281

(22) Filed: May 20, 2022

(65) Prior Publication Data

US 2022/0381041 A1 Dec. 1, 2022

Related U.S. Application Data

(60) Provisional application No. 63/193,749, filed on May 27, 2021.

(51) Int. Cl.

| | |
|---|---|
| ***E04F 15/02*** | (2006.01) |
| ***E04F 21/22*** | (2006.01) |
| ***E04F 15/024*** | (2006.01) |

(52) U.S. Cl.

CPC .. *E04F 15/02038* (2013.01); *E04F 15/02022* (2013.01); *E04F 15/02044* (2013.01);

(Continued)

(58) Field of Classification Search

CPC ..... E04F 15/02038; E04F 21/22; E04F 2201/093; E04F 15/02005; E04F 15/02194; E04F 15/02452; E04F 15/02458; E04F 15/02494; E04F 2015/0205; E04F 15/02044; E04F 15/02022

(Continued)

(56) References Cited

U.S. PATENT DOCUMENTS 5,323,575 A * 6/1994 Yeh ..... E04F 15/02 52/390

6,344,654 B1 2/2002 Lesko (Continued)

FOREIGN PATENT DOCUMENTS

| | | | | |
|---|---|---|---|---|
| CA | 2217405 A1 * | 3/1999 | ..... | E04F 21/0076 |
| GB | 2134944 A | 8/1984 | | |
| WO | WO-2005071185 A1 * | 8/2005 | ..... | E04F 15/082 |

OTHER PUBLICATIONS

International Search Report for International Application No. PCT/US22/30572 dated Oct. 7, 2022.

*Primary Examiner* — Brent W Herring

(74) *Attorney, Agent, or Firm* — Trevor Coddington; Insigne PC

(57) ABSTRACT

Interlocking modular tile frames for joining hard tiles without requiring a substrate adhesive (thin-set mortar) or grout. Each tile frame comprises integrated segments that form a rigid or semi-rigid enclosure to hold a single hard tile within its interior. Each segment has an upside-down T-shape cross-section comprising a column and a base. The columns, which frames a tile, eliminate the need for grout. An inserted tile rests on the base while being held in place by the column along each segment. One or more mechanical interconnections are located at an outer portion of each enclosure corner to couple adjacent frames together. A stain-resistant material such as but not limited to polyethylene, polycarbonate, polyvinyl chloride (PVC), polypropylene (PP), acrylic, ABS (acrylonitrile butadiene styrene), nylon, rubber, or a combination thereof, can be used for the frames.

16 Claims, 11 Drawing Sheets

(52) U.S. Cl.
CPC .. *E04F 15/02194* (2013.01); *E04F 15/02452* (2013.01); *E04F 15/02458* (2013.01); *E04F 21/22* (2013.01); *E04F 2015/0205* (2013.01); *E04F 2201/093* (2013.01)

(58) Field of Classification Search
USPC ..... 52/385, 386, 387, 456, 780
See application file for complete search history.

(56) References Cited

U.S. PATENT DOCUMENTS

| | | | | |
|---|---|---|---|---|
| 6,647,684 | B1 * | 11/2003 | Gank | E04F 15/02005 52/456 |
| 6,990,777 | B2 * | 1/2006 | Poliacek | E04F 15/02005 52/302.1 |
| 7,197,855 | B2 * | 4/2007 | Della Pepa | E04F 15/02016 52/312 |
| 8,186,116 | B2 | 5/2012 | Anderson | |
| 8,984,829 | B1 | 3/2015 | McIntosh et al. | |
| 2006/0260223 | A1 * | 11/2006 | Wang | E04F 15/087 52/177 |
| 2008/0273924 | A1 * | 11/2008 | Gonzalez | E04F 15/105 404/41 |
| 2009/0000232 | A1 * | 1/2009 | Thiers | E04F 15/02011 52/716.2 |
| 2009/0049796 | A1 * | 2/2009 | Grau | E04F 15/06 52/762 |
| 2010/0287877 | A1 * | 11/2010 | Pera-Rouhu | H05B 3/262 52/745.13 |
| 2015/0030798 | A1 * | 1/2015 | Ben-Ezri | E04C 2/324 428/64.1 |
| 2021/0131909 | A1 * | 5/2021 | Holyoake | E04F 15/02458 |

* cited by examiner

INTERCONNECTED MODULAR FRAMES FOR GROUTLESS SETTING OF HARD TILES

CROSS-REFERENCE TO RELATED APPLICATION

The present application claims priority to U.S. Provisional Patent Application No. 63/193,749, filed on May 27, 2021, and entitled "Polymer Composite Grout Tile Assembly System," the entire disclosure of which is incorporated by reference herein.

BACKGROUND OF THE INVENTION

1. Field of Invention

The present invention relates to tile setting systems.

2. Description of Related Art

Ceramic, stoneware, porcelain, and other hard tiles for floors, walls, countertops, and other surfaces require a suitable adhesive for bonding to a substrate and grout for filling crevices, especially the gaps between tiles. Grout is typically made from cementitious elements are, by nature, a very porous material that, over time, inevitably becomes stained and discolored from weather, cleaning solutions, food and beverage spills, and normal wear and tear. Chemical sealers temporarily impregnate and seal grouting materials for stain proofing or partial resistance. The best chemical sealers throughout the years have proven to be partially and temporarily effective, at best. Another common disadvantage of standard grout systems is eventual cracking and delamination from the tiling system.

A perfectly tiled surface takes time, expertise, and patience. Tile spacers achieve a consistent pattern before setting tiles and ensure that all tiles are laid equidistant from each other. However, tiles may move after the spacers are removed, and grout still has to be applied to fill the gaps between tiles. Grouting over spacers compromises the structural integrity of the grout joint. Tile laying racks are metal frames that permit the consistent patterning of multiple tiles without spacers. The racks are equipped with one or more handles that allow an installer to remove a rack before setting the tiles with grout.

Interlocking tiles include puzzle edges to join individual tiles to one another. To create a snug, tight fit, the puzzle edges require an interference fit, also referred to as a press fit or friction fit, with a degree of force to mate two tiles. Accordingly, interlocking tiles are suitable for carpets and other soft or flexible materials. Interlocking tile designs are not ideal for hard tiles as puzzle edges are easily damaged, susceptible to breaking during mating, and cannot be manufactured with sufficient precision to form a transition fit without play or movement in the joint.

SUMMARY OF THE INVENTION

The present invention overcomes these and other deficiencies of the prior art by introducing interlocking modular tile frames for joining hard tiles without requiring the substrate adhesive (thin-set mortar) or grout. In a preferred embodiment of the invention, a frame comprises four integrated segments that form a rigid or semi-rigid enclosure to hold a single hard tile within its interior body. Each segment has an upside-down T-shape cross-section comprising a column and a base. The columns, which frames a tile, eliminate the need for grout. An inserted tile rests on the base while being held in place by the column along each segment. One or more mechanical interconnections are located at an outer portion of each enclosure corner to couple adjacent frames together. A stain-resistant material such as but not limited to polyethylene, polycarbonate, polyvinyl chloride (PVC), polypropylene (PP), acrylic, ABS (acrylonitrile butadiene styrene), nylon, rubber, or a combination thereof, can be used for the frames.

In an embodiment of the invention, an interlocking modular tile frame comprises a first segment and a second segment, wherein the first segment and the second segment are interconnected at a right angle; the first segment and the second segment each comprise a column and a base, wherein the column is perpendicular to the base, wherein the column and the base on the first segment and the second segment are configured to frame a portion of a tile; a first mechanical interconnection component disposed on the base of the first segment; and a second mechanical interconnection component disposed on the base of the second segment, wherein the first mechanical interconnection component is a counterpart of the second mechanical interconnection component. The first mechanical interconnection component comprises a male protrusion, and the second mechanical interconnection component comprises a female indentation. Alternatively, the first mechanical interconnection component and the second mechanical interconnection component are genderless. The first segment and the second segment have a T-shaped cross-section. The interlocking modular tile frame may further comprise a mudflap coupled to the base of the first segment. The first mechanical interconnection component is disposed on an end of the base of the first segment. The first segment and the second segment form a corner of a quadrilateral tile frame. The first mechanical interconnection component is disposed at the corner of the quadrilateral tile frame. The interlocking modular tile frame may further comprise one or more light sources within the column of the first segment. Alternatively, the first segment comprises a fluorescent material.

In another embodiment of the invention, an interlocking modular tile frame comprises: four segments forming a square or rectangular frame configured to retain a tile, wherein each of the four segments comprises a base and a column perpendicular to the base, the base extending into an interior and an exterior of the frame; and four or more mechanical interconnection components disposed on the square or rectangular frame. The four or more mechanical interconnection components comprise two sets of counterpart mechanical interconnection components. The height of the column is flush with a height of the retained tile. The two sets of counterpart mechanical interconnection components are disposed at corners of the square or rectangular frame or the base extending into an exterior of the frame.

In yet another embodiment of the invention, an interlocking modular tile frame system comprises: a first interlocking modular tile frame configured to retain a first tile within its interior, wherein the first interlocking modular tile frame comprises a first mechanical interconnection component, a second mechanical interconnection component, a third mechanical interconnection component, and a fourth mechanical interconnection component; a second interlocking modular tile frame configured to retain a second tile within its interior, wherein the second interlocking modular tile frame comprises the third mechanical interconnection component coupled to the first mechanical interconnection component of the first interlocking modular tile frame; a third interlocking modular tile frame configured to retain a third tile within its interior, wherein the third interlocking modular tile frame comprises the fourth mechanical interconnection component coupled to the second mechanical interconnection component of the first interlocking modular tile frame; and a fourth interlocking modular tile frame configured to retain a fourth tile within its interior, wherein the fourth interlocking modular tile frame comprises the third mechanical interconnection component coupled to the first mechanical interconnection component of the third interlocking modular tile frame, and the fourth mechanical interconnection component coupled to the second mechanical interconnection component of the second interlocking modular tile frame. Each interlocking modular tile frame comprises a column and a base extending along its perimeter, the column configured to retain a tile with a press fit. The height of the column is flush with a height of the retained tile. The first interlocking modular tile frame, the second interlocking modular tile frame, the third interlocking modular tile frame, and the fourth interlocking modular tile frame form a frame to retain a fifth tile with a press fit.

The interlocking modular tile frame system of claim 17, wherein each interlocking modular tile frame further comprises a mudflap disposed on the base. The present invention is resistant to liquid-based staining and cracking problems, which have been typical throughout the history of the tile industry. Grout is eliminated as the columns along the frames replace it. Tile adhesive is also unnecessary for a floating tile floor. However, some may be preferable for securing the frames and tiles to a substrate, particularly when maximum structural integrity is preferred in heavy-weight environments. An underlayment pad may also be used in a floating floor assembly.

The foregoing and other features and advantages of the present invention will be apparent from the following, a more detailed description of the present invention's preferred embodiments and the accompanying drawings.

BRIEF DESCRIPTION OF THE DRAWINGS

For a complete understanding of the present invention, the objects, and advantages thereof, reference is now made to the ensuing descriptions taken in connection with the accompanying drawings briefly described as follows.

DETAILED DESCRIPTION OF PREFERRED EMBODIMENTS

Preferred embodiments of the present invention and their advantages may be understood by referring to FIGS. 1-10. The described features, structures, or characteristics of the invention may be combined in any suitable manner in one or more embodiments. It will be apparent to those skilled in the art that various modifications and variations can be made to the present invention without departing from its spirit and scope. Thus, the current invention is intended to cover modifications and variations consistent with the scope of the appended claims and their equivalents. Although the present invention is described in the context of hard tiles such as but not limited to ceramic, porcelain, glass, cement, marble, mosaic, granite, limestone, travertine, quarry, metal, and resin, the interlocking modular tile frames are suitable for any type of tile including soft tiles such as foam, rubber, carpet, cork laminate, and soft plastic, among others.

The present invention comprises connectable square, rectangular, or repeated-design structures, referred to each individually as a tile frame. Each tile frame supports a portion of one or one or more hard tiles. For example, a square tile frame has an exterior flange along each of the four sides of its base to support one side of another tile within the tiling system. Therefore, only half as many tile frames are required for the number of tiles needed for the surface. For example, if one hundred tiles are required for a project, fifty tile frames will be required. As the tile system is assembled, adjacent sides of tile frames create a frame with free space for tile insertion. Various patterns of connected tile frames can also be used. For example, a rectangular tile frame system may employ a half-offset pattern as described below. Each tile frame supports five tiles or a herringbone pattern where one tile frame supports approximately a tile and a half, as illustrated and described below. Tiles within the interior of each tile frame are secured via a press-fit or transition fit. Tiles can be inserted into the tile frames before installation on the floor or other substrates such as a counter or a wall or inserted after the tile frames are connected to the floor or other substrate. Multiple tile frames are connected through press-fit interlocking connectors. The frames space and set the tiles in a consistent pattern and are left on the surface after setting, eliminating the need for grout or other gap fillers.

Figure 1:
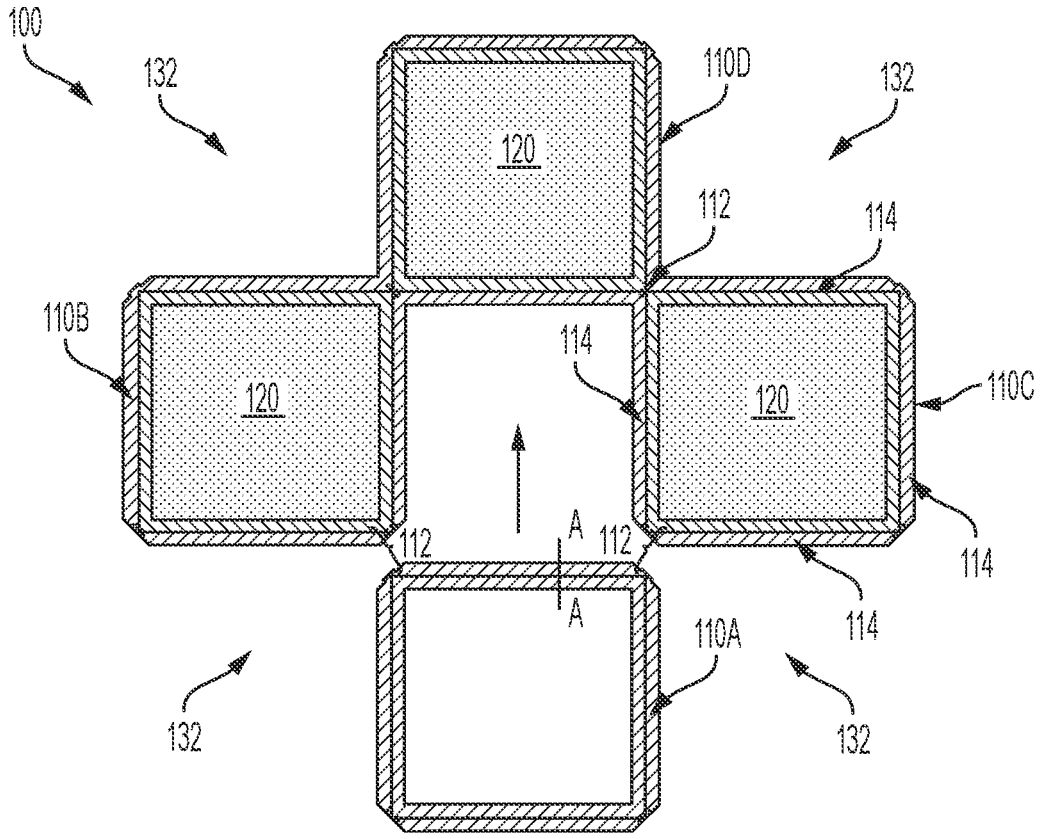
FIG. 1 illustrates an interconnected modular tile setting system according to an embodiment of the invention.

FIG. 1 illustrates an interconnected modular tile setting system 100 according to an embodiment of the invention. The system 100 comprises four tile frames 110A-D, where three tile frames 110B-D are connected via mechanical interconnections 112. Hard tiles 120 are inserted into tile frames 110B-D. Tile frame 110A, which does not have a tile inserted, is pushed inward to connect and interlock to tile frames 110B and 110C via interconnections 112. In this example, a tile 120 will be inserted into tile frame 110A after fastening and linked within system 100. Tiles 120 may be inserted into the system 100 after tile frames 110A-D are connected and interlocked, or before interlocking of each time frame, or a combination of both, depending upon the preference of an installer.

To simplify the illustration, only four tile frames 110A-D are shown. However, any number N of tile frames 110A-N can be used. For example, to cover a large surface, tens if not hundreds of tile frames 110 may be used depending on the respective size of each frame 110 or tile 120. Preferably, there is no excess play or movement of the tiles 120 within the tile frames 110. Accordingly, the inner perimeter of the tile frames 110 relative to the outer periphery of the tiles 120 should be sized to permit an interference fit or transition fit.

Each tile frame 110 comprises four integrated segments 114 to form a rigid or semi-rigid enclosure to support a tile 120 within the interior space of the tile frame 110. Tile frame 110A is connected to system 100, and the four connected tile frames 110A-D create a free space within system 100, which allows the placement of a fifth tile. Thus, only four tile frames 110A-D are needed to set the five tiles 120 shown, and to complete a square pattern, eight more segments 114 (2×4) are added at corners 132 of the system 100 to add four more tiles 120 at the corners of the system 100. For example, four half tile frames 110, halved along a center diagonal, are placed in each corner 132 to receive four more tiles 120 to complete the square layout of the system 100.

Figure 2:
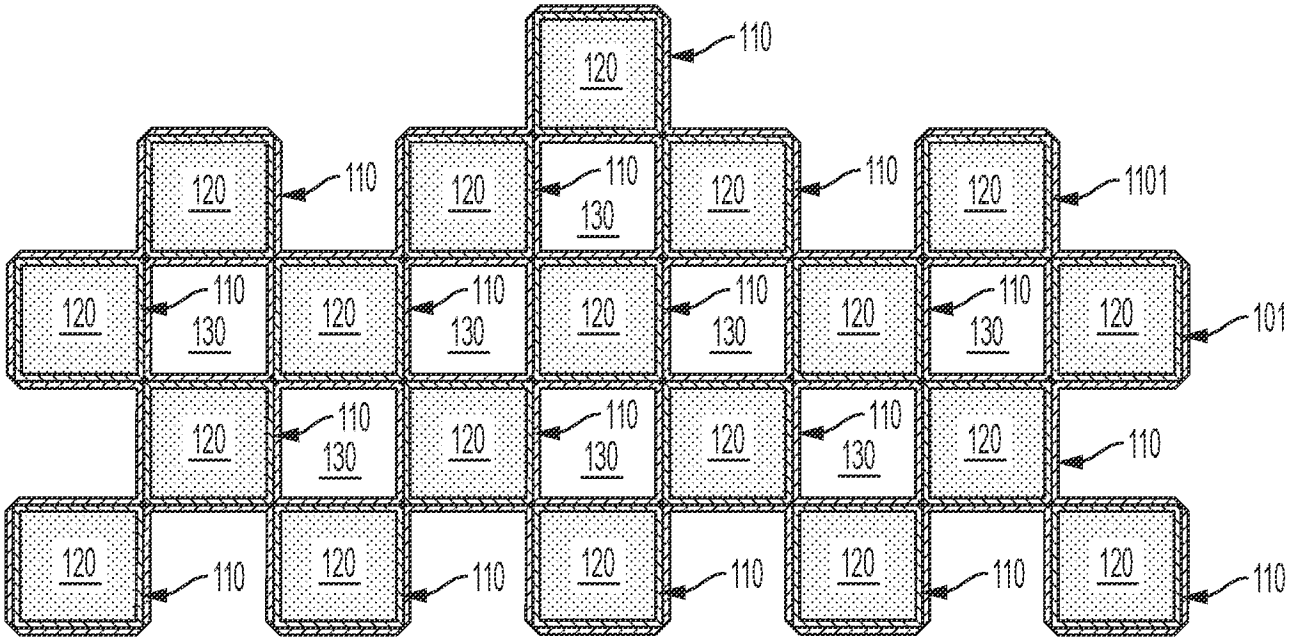
FIG. 2 shows an expansion of the interconnected modular tile setting system shown in FIG. 1.

The process may be continued by diagonally connecting individual tile frames 110 to the system 100, creating additional free tile spaces 130, as shown in FIG. 2. In the overall layout of system 100, one tile frame 110 supports two tiles 120 in square footage. Each time frame 110 may be customized to support square, rectangular, and other shaped tile formations of various sizes such as but not limited to 4", 8", 10", 12", 14", 16", 18", 20", 24", a combination of these sizes or any other sized tile.

Figure 3:
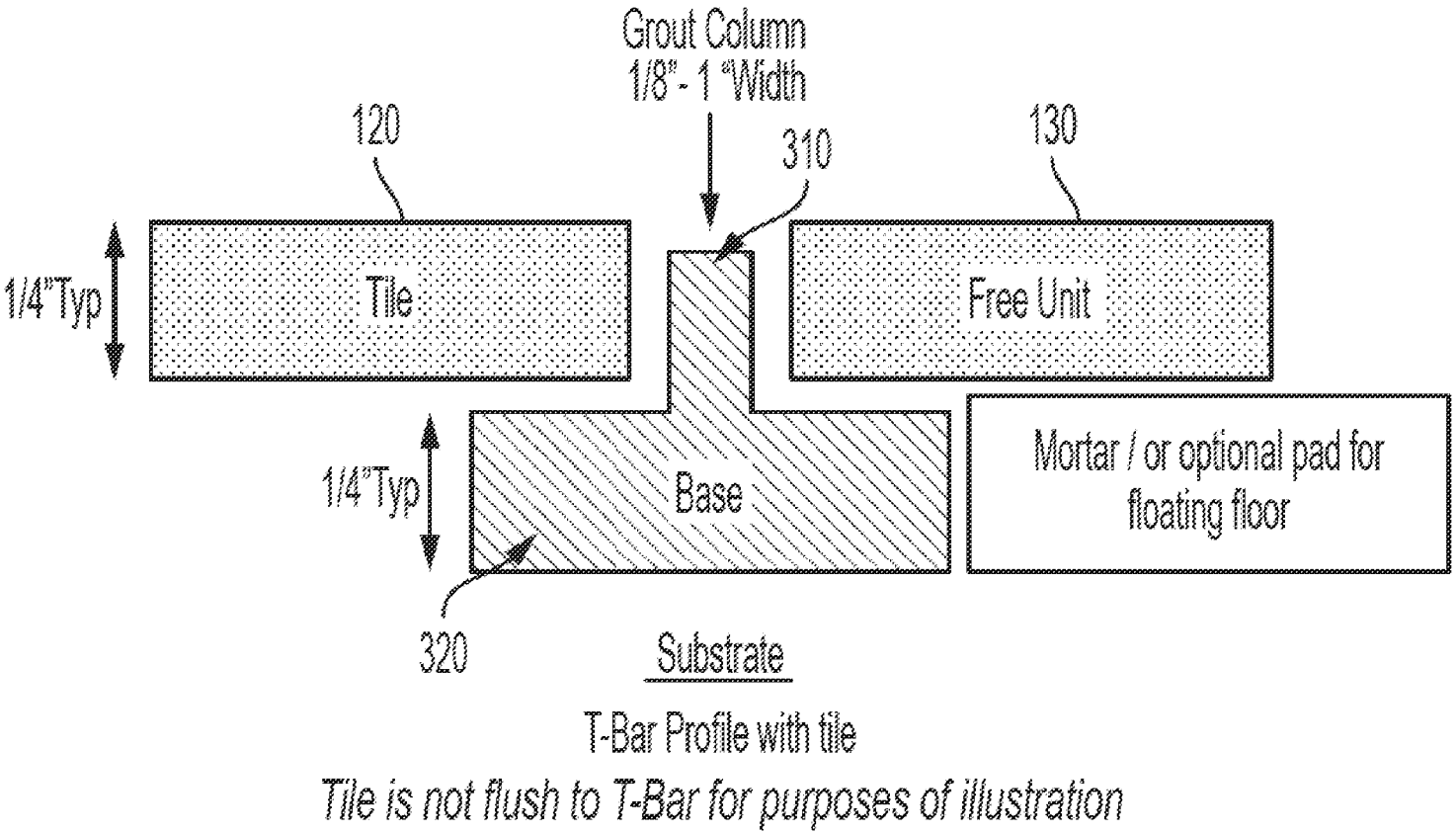
FIG. 3 illustrates a cross-section of a tile frame within the system of FIG. 1.

FIG. 3 illustrates the cross-section A-A of a segment 114 of a tile frame 101 within the system of FIG. 1. In an embodiment of the invention, each segment 114 features an upside-down T-shape profile comprising a column 310 (where grout would otherwise occupy in a grout-based system) and a base 320. Hence, column 310 is sometimes referred to as a grout column or grout strip because it takes the place ordinarily occupied by grout in conventional systems. As noted above, the interior periphery of the tile frame 110 is slightly smaller than the outer periphery of the tile 120. This allows a firm snap-in of the tile 120 into the tile frame 110. Utilizing a semi-rigid composite plastic presents a flush/tight fit between tiles 120. It is noted that most manufacturers' lines/styles of tiles fluctuate in size to a small degree, e.g., a few thousandths of an inch. The system 100 accounts for such variations. The width of column 310 may vary as desired, for example, between ⅛" and 1". The height of column 310 preferably matches the height of the tiles 120 to provide a flush surface. The height of the base 320 may be varied as well; however, ¼" or more permits optional thin-set mortar or padding, if desired, to be placed underneath the tiles 120.

Hard tiles 120 can be permanently bonded to a substrate such as a floor, a countertop, or a wall through cementitious thin-set mortar, the implementation of which is apparent to one of ordinary skill in the art. Thin-set mortar is applied to the substrate before the system 100 is assembled. Alternatively, the mortar is applied to the substrate exposed within the open interiors of the tile frames 110 after they are interlocked and before tiles 120 are inserted. The system 100 can also be installed as a floating floor with little or no thin-set mortar (not applicable for counters or walls). Assembly of a floating system 100 may utilize a padded insert on the substrate within the interior free space of the interlocked tile frames 110, slightly thicker than the height of the base 320, before insertion of the tiles 120. The pads optimize the support of the tiles 120, emphasizing floor system weight-bearing integrity. For example, each tile frame 110 would have a correspondingly-shaped pad within its interior underneath a respective tile 120.

The column 310 may be a different material than the base 320 to decrease material cost and therefore manufactured as two separate components. For example, because column 310 is exposed to the environment, including floor traffic if the substrate is a floor, the column 310 should be a wear-resistant and stain-resistant material such as but not limited to polyethylene, polycarbonate, polyvinyl chloride (PVC), polypropylene (PP), acrylic, ABS (acrylonitrile butadiene styrene), nylon, rubber, or a combination thereof, can be used for the frames. The base 320 must be an appropriate material to bear the weight of the tiles 120 and anything placed on top of the tiles 120, the identification of which is apparent to one of ordinary skill in the art. The column 310 and the base 320 can be joined via a press-fit or other fastening means, the identification and implementation of which is apparent to one of ordinary skill in the art. In an alternative embodiment of the invention, each side of the tile frame 110, e.g., the segments 114, can be a separate component, interlocked using the various interconnections described herein.

Figure 4:
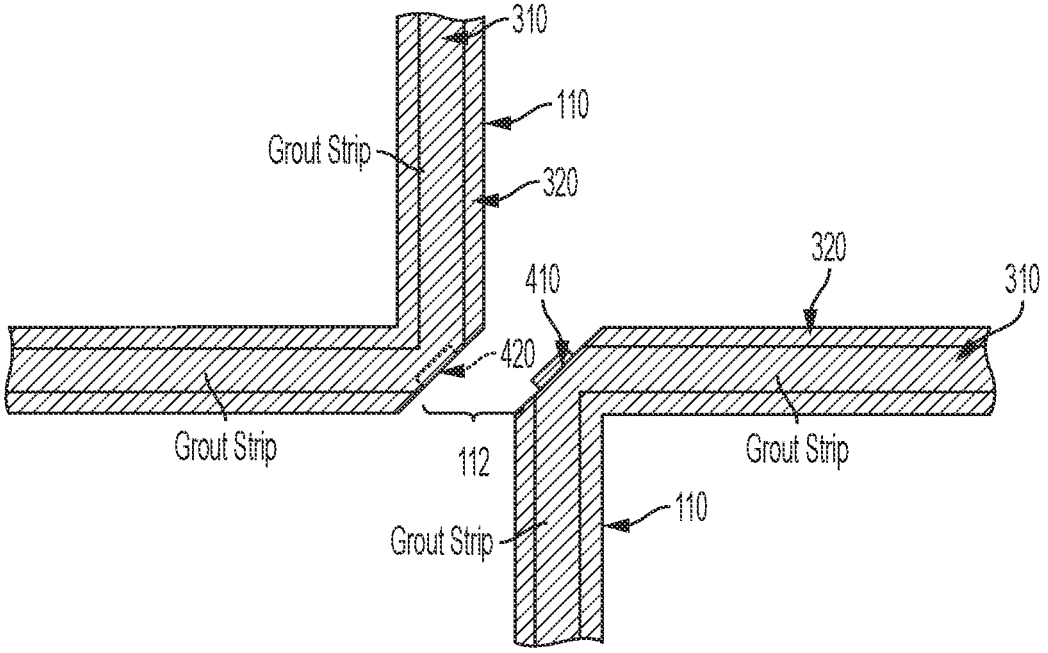
FIG. 4 illustrates a mechanical interconnection for connecting tile frames according to an exemplary embodiment of the invention.

FIG. 4 illustrates the mechanical interconnection 112 according to an exemplary embodiment of the invention. The mechanical interconnection 112 comprises a male boss or protrusion 410 at a corner of a tile frame 110 and a female indentation 420 at an opposite corner of an adjacent tile frame 110. Every tile frame 110 comprises two male protrusions 410 and two female indentations 420 dispersed among the four corners. Respective male protrusion 410 on one tile frame 110 and its female indentation 420 counterpart on another tile frame 110 are press-fitted together to join the two tile frames. Although rectangular-shaped protrusions 410 and female indentations 420 are shown, any size, number, or shaped protrusions and indentations may be used, including but not limited to puzzle, tongue, and groove, biscuit, dovetail, and dowell. Alternatively, genderless interconnections, including but not limited to stickle and Lincoln, may be employed.

Figure 5:
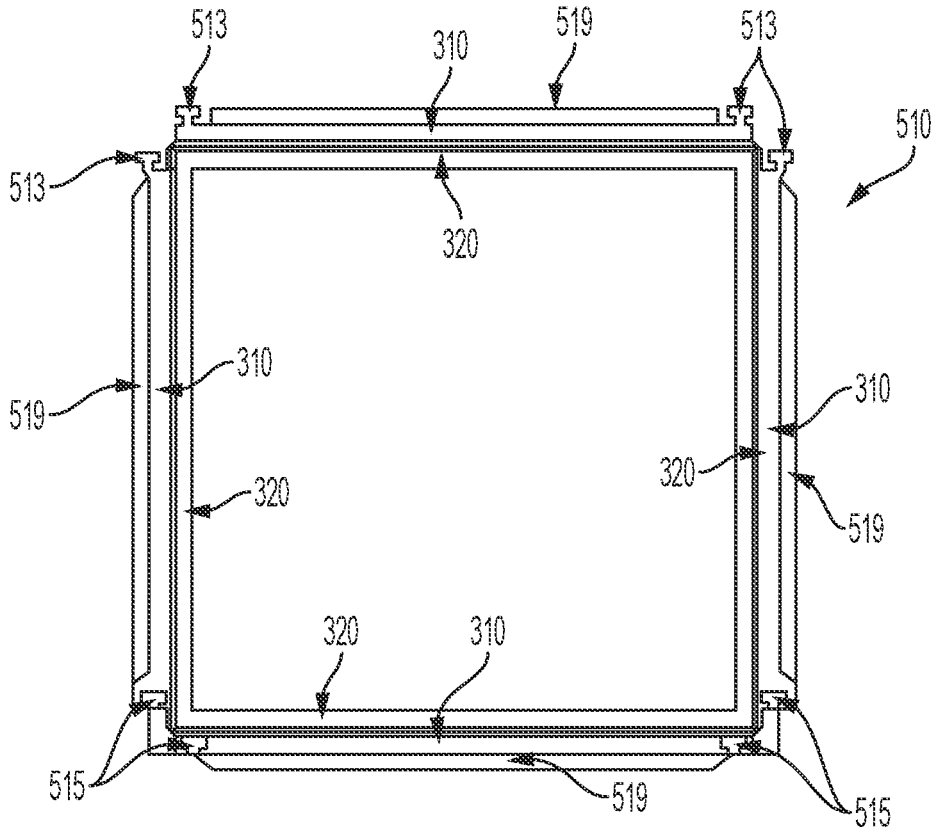
FIG. 5 illustrates a tile frame according to another embodiment of the invention.

FIG. 5 illustrates a tile frame 510 according to another embodiment of the invention. Tile frame 510 comprises two male protrusions 513 or two female indentations 515 at the corners of segments 514. Square-shaped protrusions provide a secure interconnection among tile frames 510. As noted above, any size, number, or shaped protrusions and indentations may be implemented in place of protrusions 513 and indentations 515, including genderless interconnections.

Figure 6:
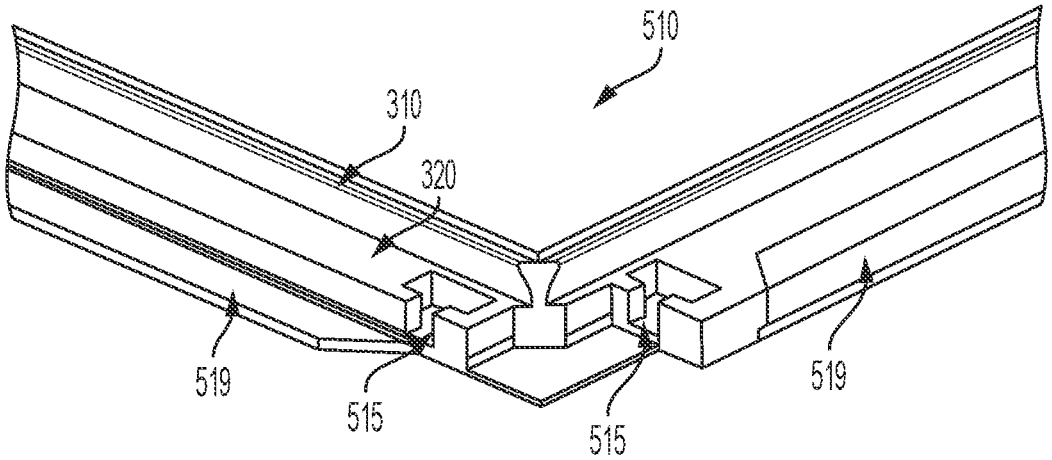
FIG. 6 illustrates a female corner of the tile frame of FIG. 5.

FIG. 6 illustrates a female corner of the tile frame 510. Each side segment's cross-section is an upside-down T-shaped with a column 310 and a base 320 underneath the column 310 as in the tile frame 110, as shown in FIG. 1. The female indentations 515 are located at the ends of the exterior portions of the bases 320. Optional flaps or mud flaps 519 may be included on the outer parts of the base 320 for free space tiles 130. Assuming an installer uses thin-set mortar, the flaps 519 will depress the mud away from base 310, where a tile 120 will be sitting. There must be no foreign contaminates between the tile 120 and the base 320 it sits upon, as the tile 120 and the top of the column 310 must be perfectly flush. The mudflaps 519 are not needed within the interior of the tile frame 110 because an installer may pre-set the tile 120 into the tile frame 120 before installing it on the substrate. Pre-installation of the tiles 120 is not needed with a floating floor or partial adhesion using a caulking gun application adhesive.

Figure 7:
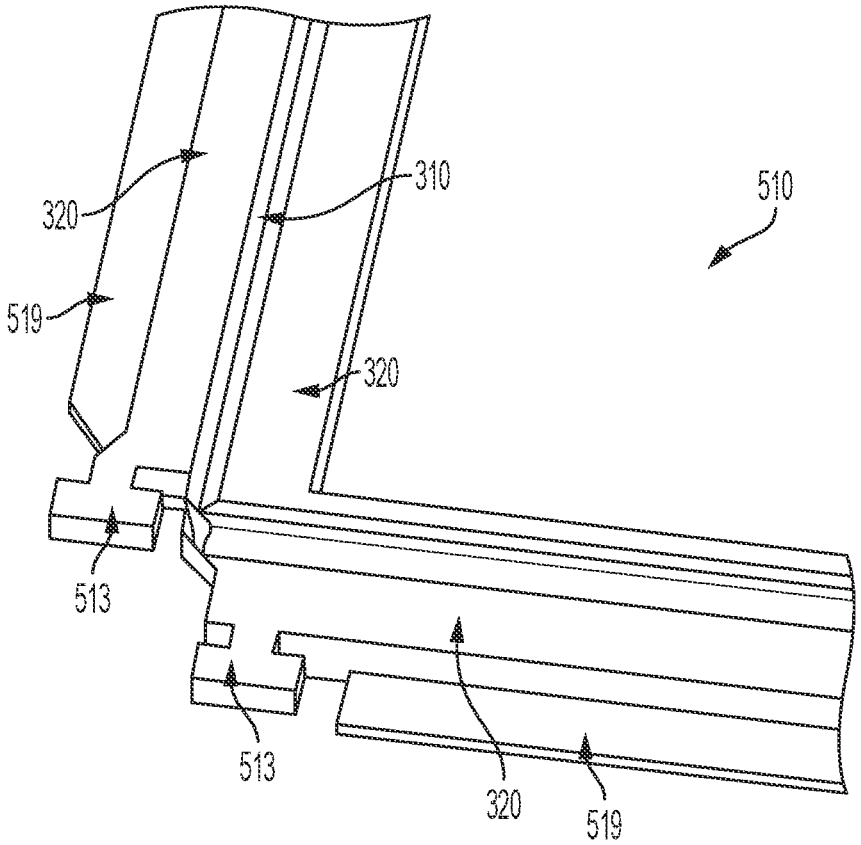
FIG. 7 illustrates a male corner of the tile frame of FIG. 5.

FIG. 7 illustrates a male corner of the tile frame 510. Here, the male protrusions 513 extend from the corner ends of the base 320 along two sides of the tile frame 510. Here, the male protrusions 513 are depicted as T-shaped protrusions.

However, any shape may be implemented so long as the female counterpart is similarly shaped. Any size, number, or shaped protrusions and indentations may be used. Alternatively, genderless interconnections may be employed.

Figure 8:
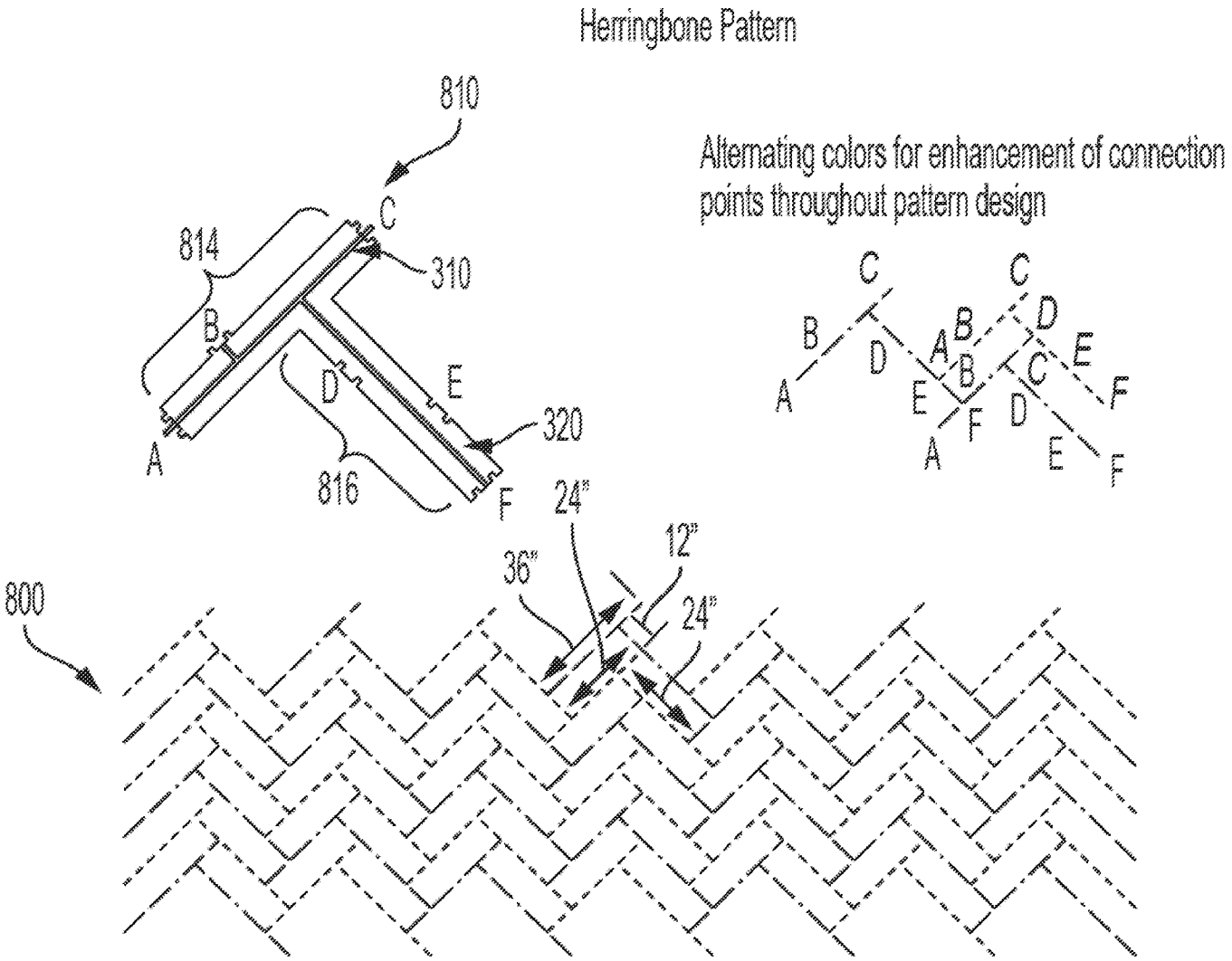
FIG. 8 illustrates an interconnected modular tile setting system utilizing a herringbone pattern according to an embodiment of the invention.

FIG. 8 illustrates an interconnected modular tile setting system 800 utilizing a rectangular herringbone pattern according to an embodiment of the invention. Here, a tile frame 810 comprises a first segment 814 and a second segment 816 combined at a ninety angle, as shown. In other words, the axis running along the length of the first segment 814 is perpendicular to the axis running along the length of the second segment 816. Multiple tile frames 810 are designed to connect at connection locations A, B, C, D, E, and F. For example, a number (two, as shown) of female or male connectors are located at each A-F position. However, any size, number, or shaped protrusions and indentations may be used. Alternatively, genderless interconnections may be employed. The connectors at A connect to their counterpart connectors at E. The connectors at B connect to their counterpart connectors at F. The connectors at C connect to their counterpart connectors at D. This creates an integrated connected pattern of spaces for the insertion of rectangular tiles in the design of what is termed in the industry as a herringbone pattern. In this system 800, the tiles could not be pre-inserted into the tile frames but would be inserted after the frames were assembled on the substrate. An exemplary embodiment of the invention, the tile size is 12"×24," but any size tile can be utilized. Mudflaps 519 can also be designed into this system 800, as noted above.

Figure 9:
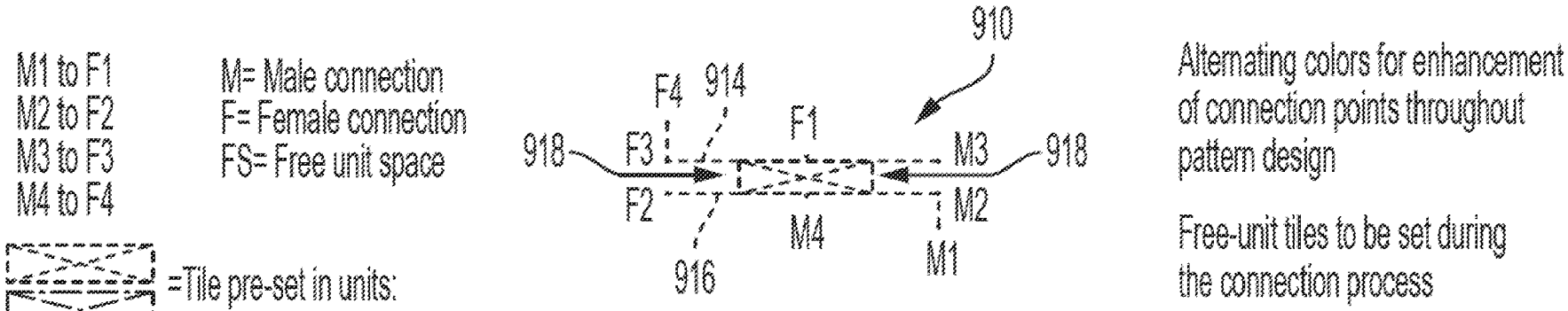
FIG. 9 illustrates an interconnected modular tile setting system utilizing a half-offset pattern according to an embodiment of the invention.
Figure 9:
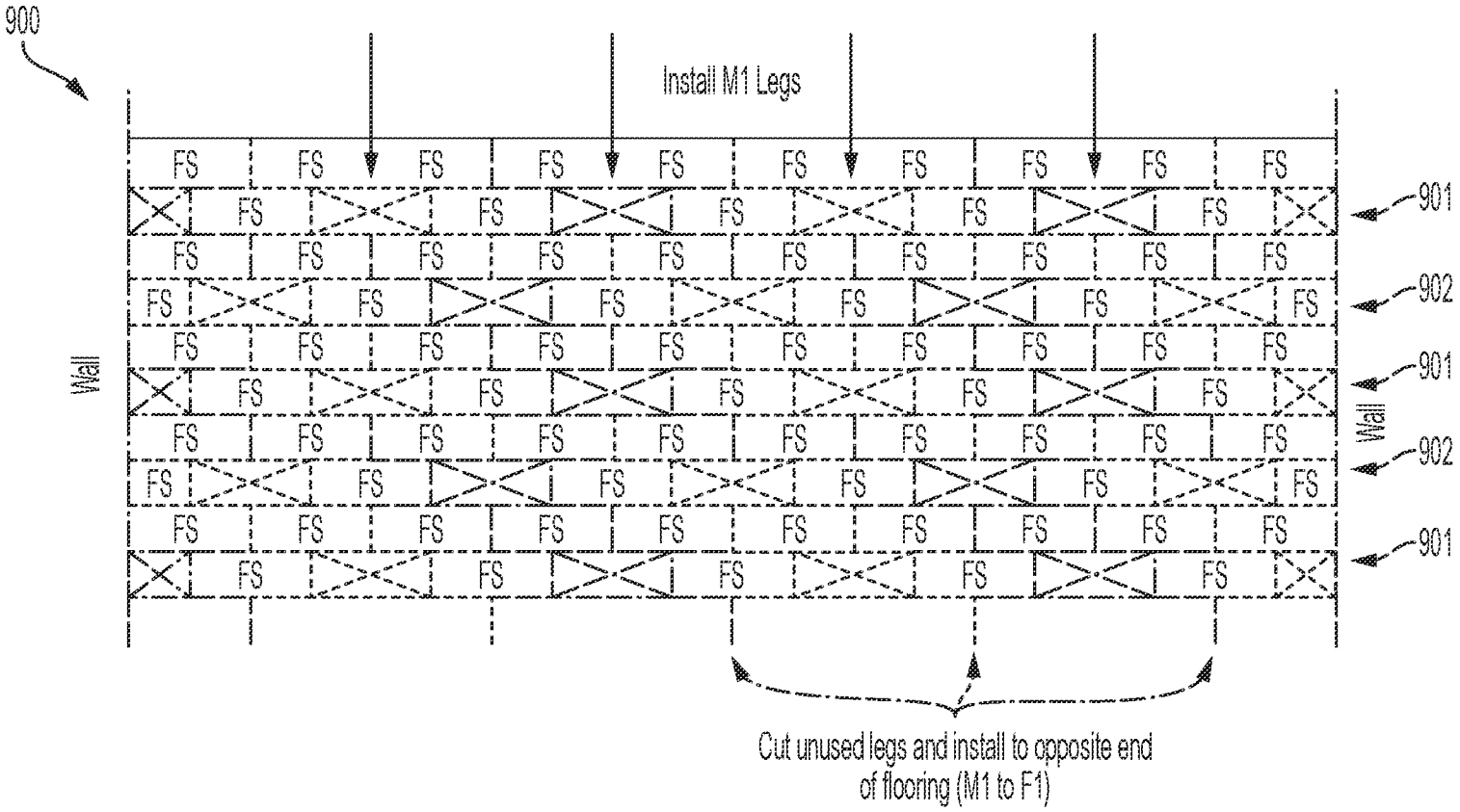

FIG. 9 illustrates an interconnected modular tile setting system 900 utilizing a half-offset pattern according to an embodiment of the invention. Here, a tile frame 910 comprises a first L-shaped segment 914 (with ends at locations M3 and F4) and a second L-shaped segment 916 (with ends at locations M13 and F2) combined via two segments 918, as shown. All segments 914, 916, and 918 comprise the column 310, the base 320, and optional mud flaps 519, as disclosed above. Like the frames discussed above, any size, number, or shaped interconnections may include genderless interconnections. The respective connectors are located at M1-M4 and F1-F4. The connector at M1 connects to its counterpart connector at F1. The connector at M2 connects to its counterpart connector at F2. The connector at M3 connects to its counterpart connector at F4.

The tiles 120 are inserted into the interior of the frames 910, denoted by cross-hatching. Adjacent rows 901 and 902 of tile frames 910 are to be assembled. The lower legs at M1 of row 901 (shown at bottom) are cut off and saved for other purposes. This row 901 is then set flush to a wall with the upper legs F4, pointing upwards, to be connected to the second row of assembled tile frames. The upper legs F4 on the first row 901 attach to the lower body portion of the next upper row 902 (F4 to M4). As this process is continued, an entire row of free space areas (denoted by "FS") is created between rows 901 and 902, as well as additional free space areas at every other point (horizontally) within each row 901 and 902.

In various embodiments of the invention, tile frames may comprise aluminum and other metallic-based materials, silicone-based materials, and rubber-based materials. Pigmentation may be used to enhance specific colors. One or more textures may be included on the top of column 310 for aesthetics or to prevent slipping. The tile frames taught herein can be manufactured utilizing 3D printing, injection molding, casting processes, forged processes, extrusion methods, or stamping/die processes, among others suitable for the materials disclosed, the identification and implementation of which are apparent to one of ordinary skill in the art.

The materials mentioned above and manufacturing processes may be customized to produce various pigmented options for the grout column in this system. The color, texture, and thicknesses of grout columns can be modified to present unique aesthetic appearances that are impossible within conventional cementitious grouting products. Alternating colors among adjacent tiles frames is also possible with this system, considering the advantages of particular manufacturing processes mentioned above, i.e., 3D printing capabilities. For example, various segments or two sides of a tile frame can be designed in one color and the other two sides in another color. This color and texture variation opens new and creative opportunities for innovative designs.

In addition, the present invention provides precise dimensional accuracy during the installation of the tile system. Standard tile setting processes require spacers and installer accuracy. Even with the most skilled and seasoned installer, all projects invariably will have areas that are not perfect right angles within tile settings. The present invention is engineered to ensure consistent dimensions and angles throughout the entire project with its interlocking connections.

Figure 10:
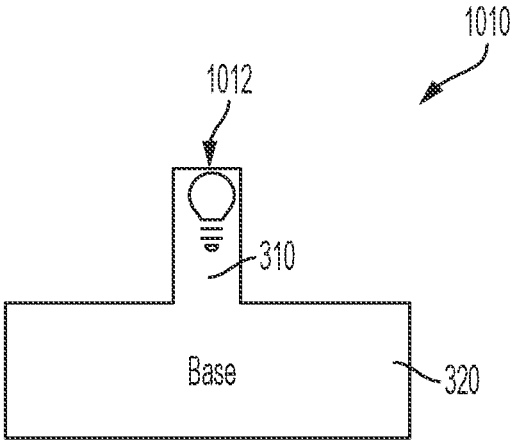
FIG. 10 illustrates a segment cross-section of a lighted tile frame according to an embodiment of the invention.

FIG. 10 illustrates a cross-section of a segment of a lighted tile frame 1010 according to an embodiment of the invention. The column 310 comprises one or more light sources 1012 along its top surface. A plurality of light source 1012 can run along the entire column perimeter of the tile frame 1010. Exemplary light sources 1012 include but are not limited to individual light-emitting diodes (LED), LED strips, rope lights, and LED neon lights. Each light source 1012 may be flush with the top surface of column 310 or below the top surface. For the latter configuration, column 310 is preferably transparent or semitransparent. Low voltage electrical wiring in the tile frame 1010, the implementation of which is apparent to one of ordinary skill in the art, couples the light sources 1012 to one another, light sources 1012 on adjacent tile frames 1010, or to an external power source (not shown). Lighted tile frames offer a unique ambiance and a lighted pathway. In addition, a fluorescent material such as aluminate can be incorporated into a tile frame so that it charges through natural or synthetic light to emit a soft fluorescent glow.

The primary design configuration of each tile frame is intended to be as a whole unit with all four sides manufactured together as a whole or one singular part. However, other configurations are also proposed as a practical means of design. The tile frame can also comprise two L-shaped T-bar components halving the whole unit at two diagonal corners. In this concept, the ends of the two L-shaped components would be designed with similar interlocking connection points. Another option is four separate individual straight T-bar legs dividing the square/rectangle into four separate legs with similar connection points.

The invention has been described herein using specific embodiments for illustration only. However, it will be readily apparent to one of ordinary skill in the art that the principles of the invention may be embodied in other ways. Therefore, the invention should not be regarded as limited in scope to the specific embodiments and claims.

The invention claimed is:

1. An interlocking modular tile frame comprising:

a first segment and a second segment, wherein the first segment and the second segment are arranged as a whole and at a right angle to form a corner of the interlocking modular tile frame;

the first segment and the second segment each comprise a column and a base, wherein the column is perpendicular to the base with a first portion of the base extending into an interior space of the interlocking modular tile frame and a second portion of the base extending into an outer periphery of the interlocking modular tile frame, wherein the column and the first portion of the base of the first segment and the second segment are configured to frame a portion of a first tile inserted into the interior space of the interlocking modular tile frame, and the column and the second portion of the base are configured to frame a portion of a second tile and third tile placed adjacent to the first segment and the second segment at the outer periphery of the interlocking modular tile frame;

a first mechanical interconnection component disposed on the second portion of the base of the first segment; and a second mechanical interconnection component disposed on the second portion of the base of the second segment, wherein the first mechanical interconnection component is a counterpart of the second mechanical interconnection component, wherein the first mechanical interconnection component comprises a T-shaped male protrusion and the second mechanical interconnection component comprises a T-shaped female indentation.

2. The interlocking modular tile frame of claim 1, wherein the first mechanical interconnection component is disposed on an end of the base of the first segment.

3. The interlocking modular tile frame of claim 1, wherein the interlocking modular tile frame is a quadrilateral tile frame.

4. The interlocking modular tile frame of claim 3, wherein the first mechanical interconnection component is disposed at the corner of the quadrilateral tile frame.

5. An interlocking modular tile frame comprising:

a first segment and a second segment, wherein the first segment and the second segment are arranged as a whole and at a right angle to form a corner of the interlocking modular tile frame;

the first segment and the second segment each comprise a column and a base, wherein the column is perpendicular to the base with a first portion of the base extending into an interior space of the interlocking modular tile frame and a second portion of the base extending into an outer periphery of the interlocking modular tile frame, wherein the column and the first portion of the base of the first segment and the second segment are configured to frame a portion of a first tile inserted into the interior space of the interlocking modular tile frame, and the column and the second portion of the base are configured to frame a portion of a second tile and third tile placed adjacent to the first segment and the second segment at the outer periphery of the interlocking modular tile frame;

a first mechanical interconnection component disposed on the second portion of the base of the first segment; and a second mechanical interconnection component disposed on the second portion of the base of the second segment, wherein the first mechanical interconnection component is a counterpart of the second mechanical interconnection component, wherein the first mechanical interconnection component and the second mechanical interconnection component are genderless.

6. An interlocking modular tile frame comprising:

a first segment and a second segment, wherein the first segment and the second segment are arranged as a whole and at a right angle to form a corner of the interlocking modular tile frame;

the first segment and the second segment each comprise a column and a base, wherein the column is perpendicular to the base with a first portion of the base extending into an interior space of the interlocking modular tile frame and a second portion of the base extending into an outer periphery of the interlocking modular tile frame, wherein the column and the first portion of the base of the first segment and the second segment are configured to frame a portion of a first tile inserted into the interior space of the interlocking modular tile frame, and the column and the second portion of the base are configured to frame a portion of a second tile and third tile placed adjacent to the first segment and the second segment at the outer periphery of the interlocking modular tile frame;

a first mechanical interconnection component disposed on the second portion of the base of the first segment;

a second mechanical interconnection component disposed on the second portion of the base of the second segment, wherein the first mechanical interconnection component is a counterpart of the second mechanical interconnection component; and a mudflap coupled to the base of the first segment.

7. An interlocking modular tile frame comprising:

a first segment and a second segment, wherein the first segment and the second segment are arranged as a whole and at a right angle to form a corner of the interlocking modular tile frame;

the first segment and the second segment each comprise a column and a base, wherein the column is perpendicular to the base with a first portion of the base extending into an interior space of the interlocking modular tile frame and a second portion of the base extending into an outer periphery of the interlocking modular tile frame, wherein the column and the first portion of the base of the first segment and the second segment are configured to frame a portion of a first tile inserted into the interior space of the interlocking modular tile frame, and the column and the second portion of the base are configured to frame a portion of a second tile and third tile placed adjacent to the first segment and the second segment at the outer periphery of the interlocking modular tile frame;

a first mechanical interconnection component disposed on the second portion of the base of the first segment;

a second mechanical interconnection component disposed on the second portion of the base of the second segment, wherein the first mechanical interconnection component is a counterpart of the second mechanical interconnection component; and one or more light sources within the column of the first segment.

8. An interlocking modular tile frame comprising:

a first segment and a second segment, wherein the first segment and the second segment are arranged as a whole and at a right angle to form a corner of the interlocking modular tile frame;

the first segment and the second segment each comprise a column and a base, wherein the column is perpendicular to the base with a first portion of the base extending into an interior space of the interlocking modular tile frame and a second portion of the base extending into an outer periphery of the interlocking modular tile frame, wherein the column and the first portion of the base of the first segment and the second segment are configured to frame a portion of a first tile inserted into the interior space of the interlocking modular tile frame, and the column and the second portion of the base are configured to frame a portion of a second tile and third tile placed adjacent to the first segment and the second segment at the outer periphery of the interlocking modular tile frame;

a first mechanical interconnection component disposed on the second portion of the base of the first segment; and a second mechanical interconnection component disposed on the second portion of the base of the second segment, wherein the first mechanical interconnection component is a counterpart of the second mechanical interconnection component, wherein the column of the first segment comprises a fluorescent material.

9. An interlocking modular tile frame comprising:

four segments arranged as a whole forming a square or rectangular interlocking modular tile frame configured to retain a tile, wherein each of the four segments comprises a base and a column perpendicular to the base, the base extending into an interior space of the interlocking modular tile frame on one side of the column and extending into an outer periphery of the modular tile frame on the opposite side of the column; and four or more mechanical interconnection components disposed on each base extending into an outer periphery of the four segments of the square or rectangular interlocking modular tile frame, wherein the four or more mechanical interconnection components comprise two sets of counterpart T-shaped mechanical interconnection components.

10. The interlocking modular tile frame of claim 9, wherein a height of the column is flush with a height of the retained tile.

11. The interlocking modular tile frame of claim 9, wherein the two sets of counterpart T-shaped mechanical interconnection components are disposed at corners of the square or rectangular interlocking modular frame.

12. An interlocking modular tile frame system comprising:

a first interlocking modular tile frame arranged as a whole and configured to retain a first tile within its interior, wherein the first interlocking modular tile frame comprises a first mechanical interconnection component, a second mechanical interconnection component, a third mechanical interconnection component, and a fourth mechanical interconnection component;

a second interlocking modular tile frame arranged as a whole and configured to retain a second tile within its interior, wherein the second interlocking modular tile frame comprises the third mechanical interconnection component coupled to the first mechanical interconnection component of the first interlocking modular tile frame;

a third interlocking modular tile frame arranged as a whole and configured to retain a third tile within its interior, wherein the third interlocking modular tile frame comprises the fourth mechanical interconnection component coupled to the second mechanical interconnection component of the first interlocking modular tile frame; and a fourth interlocking modular tile frame arranged as a whole and configured to retain a fourth tile within its interior, wherein the fourth interlocking modular tile frame comprises the third mechanical interconnection component coupled to the first mechanical interconnection component of the third interlocking modular tile frame, and the fourth mechanical interconnection component coupled to the second mechanical interconnection component of the second interlocking modular tile frame, wherein the first interlocking modular tile frame, the second interlocking modular tile frame, the third interlocking modular tile frame, and the fourth interlocking modular tile frame each comprise a column and a base, the base comprising a first portion extending into an interior space and a second portion extending into an outer periphery, wherein the first mechanical interconnection component, the second mechanical interconnection component, the third mechanical interconnection component, and the fourth mechanical interconnection component each comprise a T-shaped male protrusion or T-shaped female indentation disposed at the second portion of the base.

13. The interlocking modular tile frame system of claim 12, wherein each interlocking modular tile frame is configured to retain a tile with a press fit.

14. The interlocking modular tile frame system of claim 13, wherein a height of the column is flush with a height of the retained tile.

15. The interlocking modular tile frame system of claim 14, wherein the first interlocking modular tile frame, the second interlocking modular tile frame, the third interlocking modular tile frame, and the fourth interlocking modular tile frame form a frame to retain a fifth tile with a press fit.

16. The interlocking modular tile frame system of claim 13, wherein each interlocking modular tile frame further comprises a mudflap disposed on the base.

* * * * *